US009144357B2

(12) United States Patent
Vennegoor Op Nijhuis et al.

(10) Patent No.: US 9,144,357 B2
(45) Date of Patent: Sep. 29, 2015

(54) ROBOTIC VACUUM CLEANER WITH REMOVABLE DUST CONTAINER

(71) Applicant: KONINKLIJKE PHILIPS N.V., Eindhoven (NL)

(72) Inventors: Jeroen Johannes Gerardus Vennegoor Op Nijhuis, Eindhoven (NL); Guy Anthony Brown, Eindhoven (NL); Gijs Janssens, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/400,066

(22) PCT Filed: May 6, 2013

(86) PCT No.: PCT/IB2013/053604

§ 371 (c)(1),
(2) Date: Nov. 10, 2014

(87) PCT Pub. No.: WO2013/171618

PCT Pub. Date: Nov. 21, 2013

(65) Prior Publication Data

US 2015/0113761 A1 Apr. 30, 2015

Related U.S. Application Data

(60) Provisional application No. 61/646,459, filed on May 14, 2012.

(51) Int. Cl.
*A47L 9/10* (2006.01)
*A47L 9/14* (2006.01)

(52) U.S. Cl.
CPC ..... *A47L 9/1481* (2013.01); *A47L 9/1409* (2013.01); *A47L 2201/00* (2013.01)

(58) Field of Classification Search
CPC .. A47L 9/1481; A47L 9/1409; A47L 2201/00
USPC ..... 15/353
IPC ..... A47L 9/10
See application file for complete search history.

(56) References Cited

U.S. PATENT DOCUMENTS

| | | | | |
|---|---|---|---|---|
| 7,578,020 | B2 | 8/2009 | Jaworski | |
| 8,732,901 | B2 * | 5/2014 | Shim et al. | 15/347 |
| 2004/0187249 | A1 | 9/2004 | Jones | |
| 2005/0015920 | A1 | 1/2005 | Kim | |

(Continued)

FOREIGN PATENT DOCUMENTS

| | | | |
|---|---|---|---|
| DE | 102011054162 | A1 | 4/2013 |
| EP | 1917896 | B1 | 5/2008 |

(Continued)

OTHER PUBLICATIONS

Samsung, "Robotic Vacuum Cleaner", User Manuel SR8845. pp. 1-48.
Samsung, "Vacuum Cleaner" Operating Instructions. pp. 1-12.

*Primary Examiner* — David Redding

(57) ABSTRACT

Robotic vacuum cleaner (1) including: a housing (100) defining a dust container reception compartment (108) that has a dust container reception opening (110) in an outer surface (102) of the housing; a dust container (200) configured to be removably receivable inside the compartment (108) via the dust opening, such that, in an operationally received condition, an outer push surface (208) of the dust container is flush with the outer surface of the housing, while in a removably received condition, the push surface (208) protrudes outwardly from said outer surface (102) of the housing; and a push-push mechanism (300) configured to maintain a received dust container in said operationally received condition when the push surface is pushed inwards into the housing and released a first time, and to force the dust container from said operationally received condition into the removably received condition when pushed inwards and released a second time.

10 Claims, 4 Drawing Sheets

(56) References Cited

U.S. PATENT DOCUMENTS

2005/0217042 A1* 10/2005 Reindle ..... 15/41.1
2013/0031744 A1 2/2013 Ota

FOREIGN PATENT DOCUMENTS

GB 2401777 A 11/2004
WO 2012149575 A2 11/2012

* cited by examiner

ROBOTIC VACUUM CLEANER WITH REMOVABLE DUST CONTAINER

This application is the U.S. National Phase application under 35 U.S.C. §371 of International Application No. PCT/IB2013/053604, filed on May 6, 2013, which claims the benefit of U.S. Provisional Application No. 61/646,459 filed on May 14, 2012. These applications are hereby incorporated by reference herein.

FIELD OF THE INVENTION

The present invention relates to a robotic vacuum cleaner with an internal, removable dust container.

BACKGROUND

Robotic vacuum cleaners (RVCs) are known in the art, and normally intended to move autonomously—i.e. without human supervision or guidance—through the rooms of a house. Consequently an RVC's outer shape is of particular importance. After all, any recess or projection that forms a potential point of engagement may cause the RVC to catch on something, e.g. a piece of furniture, and get stuck. If, in such a case, the RVC is incapable of releasing itself, it may have to be set free manually by its owner before it can continue its work. The call for a smooth outer shape is therefore primarily a matter of function, but it is noted that it may well be in line with the general pursuit of an aesthetically pleasing 'clean design'.

At the same time, however, an RVC may be fitted with an internal, removable dust container that requires periodic emptying. To facilitate removal of the dust container from the housing of the RVC, the dust container may be provided with a handle or other hand-grippable feature. An obvious drawback of such a feature is that it increases the risk that the RVC is accidentally entangled during operation. This risk may, at least in some designs, be mitigated by providing the feature in a collapsible form, e.g. a hinged dust container handle that can be folded down into a corresponding recess in an outer wall of the housing of the RVC. Unfortunately, such solutions are hardly ever satisfactory from an aesthetic point of view, in particular because they may leave extra and rather perceptible seams or grooves, exclusively related to the technical dust container removal-functionality, in the visible outer surface of the RVC.

SUMMARY OF THE INVENTION

It is an object of the present invention to overcome or mitigate the aforementioned issues, and to provide for a solution that enables the construction of a robotic vacuum cleaner with an easily removable dust container at a minimum of removal function-related, outwardly visible features.

To this end, a first aspect of the present invention is directed to a robotic vacuum cleaner (RVC). The RVC may comprise a housing that defines a dust container reception compartment with a dust container reception opening located in an outer surface of the housing. The RVC may also comprise a dust container configured to be removably receivable inside the dust container reception compartment via the dust container reception opening, such that, in an operationally received condition, an outer push surface of the dust container extends flush with the outer surface of the housing, while, in a removably received condition, the outer push surface of the dust container protrudes outwardly beyond said outer surface of the housing. The RVC may further comprise a push-push mechanism that is configured to maintain a received dust container in the operationally received condition when the outer push surface of the dust container is pushed inwards into the housing and released a first time, and to force the dust container from the operationally received condition into the removably received condition when pushed inwards into the housing and released a second time. That is, the push-push mechanism may be configured to alternatively maintain a received dust container in the operationally received condition and the removably received condition, and enable switching between these received conditions by pressing the push surface of the dust container inwards into the housing and subsequently releasing it.

The presently disclosed RVC may thus include a removable dust container that, during operation, may be sunk into a dust container reception compartment provided in the housing. In this operationally received condition, the outer push surface of the dust container—which may be smooth, and for instance flat—may sit flush with the outer surface of the housing defining the dust container reception opening. In a preferred embodiment, the push surface may preferably cover substantially the entire opening, i.e. at least ninety percent of its area, much like a lid, so as to withdraw the opening from the eye. When removal of the dust container from the housing is desired, a user may press down on the push surface thereof. Upon subsequent release, the push-push mechanism may cause the dust container to pop out into its removably received condition, in which it can be hand-gripped and lifted from the housing. Accordingly, the RVC implements a removable dust container without the use of permanently visible or engageable grips, and thus enables both a functionally smooth and aesthetically pleasing design.

The dust container reception opening may in principle be provided in any outer surface of the housing, e.g. a bottom surface or a side surface thereof. In a preferred embodiment, however, the dust container reception opening may be provided in a top surface of the housing, i.e. a surface that faces upwards during normal operation of the robotic vacuum cleaner, so as to warrant easy and direct access to the push surface normally enclosed within the circumferential edge of the opening.

When the dust container is in its removably received condition, it may be hand-gripped by a user and lifted from the dust container reception compartment altogether. To enable the gripping of the container, the dust container, and in particular the push surface thereof, may have to protrude sufficiently beyond the outer surface of the housing that provides for the dust container reception opening. In a preferred embodiment, the push surface may protrude at least 5 mm, and more preferably at least 10 mm, from said outer surface in the removably received condition.

In addition, the dust container may define a circumferential region that, in the removably received condition, extends between a circumferential edge of the push surface of the dust container and a circumferential edge of the dust container reception opening in the outer surface of the housing, which circumferential region may define a grip enhancing surface feature. In one embodiment, the grip enhancing surface feature may include a high-friction or roughened (anti-slip) surface, e.g. a rubber surface. In another embodiment, the grip enhancing surface feature may include at least one of a surface protrusion and a surface depression, such as a circumferential recess or rib. An advantage of the latter features over the high-friction surface is that they may reduce the risk that the dust container gets stuck inside the dust container reception compartment due to friction between the circumferential region and an inner wall of the dust container reception compartment.

One skilled in the art will appreciate that the push-push mechanism of the RVC may be implemented in a variety of ways. In a typical embodiment, the push-push mechanism may include at least one push-push actuator, i.e. a device that alternatively assumes an extended and contracted configuration when subjected to repeated, external pushes that normally tend to compress the device along a certain direction. Push-push actuators in themselves are well known in the art, for instance in ballpoint pens, kitchen cabinets, and memory card slots in computers, and their construction will not be elaborated upon here. It is merely noted that in principle any type of push-push actuator, for instance mechanical or electro (magnetic)-mechanical, may be employed. In some embodiments, the push-push mechanism may further include a mechanical linkage that may amplify the action of the push-push actuator, and/or transfer its action to a suitable point of application on the dust container.

These and other features and advantages of the invention will be more fully understood from the following detailed description of certain embodiments of the invention, taken together with the accompanying drawings, which are meant to illustrate and not to limit the invention.

DETAILED DESCRIPTION

Figure 1:
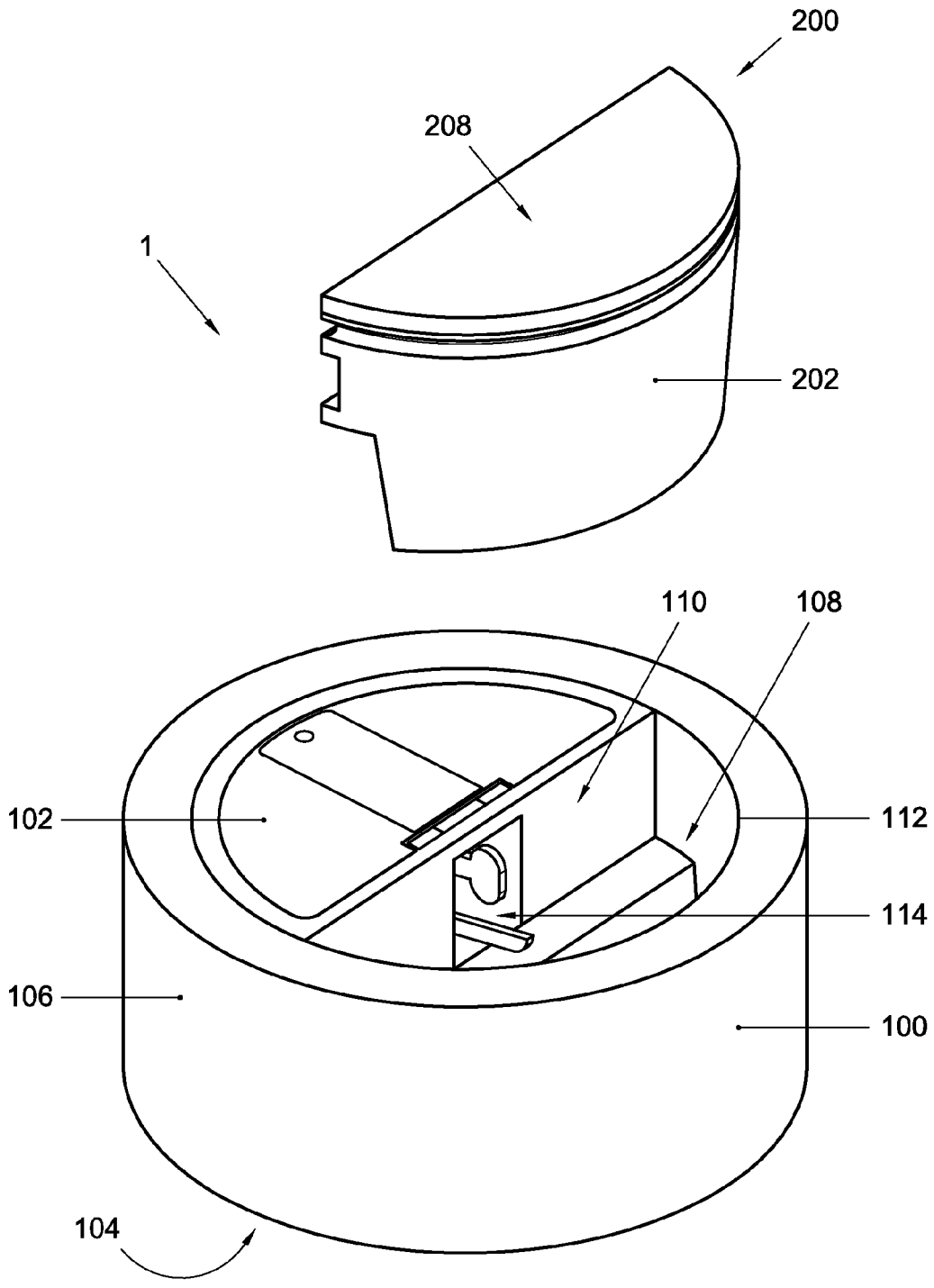
FIG. 1 is a schematic perspective view of a robotic vacuum cleaner according to the present invention.

FIG. 1 is a partially exploded perspective view of a robotic vacuum cleaner (RVC) 1 according to the present invention, including a housing 100 and a removable dust container 200. Except insofar as the RVC's dust container reception and ejection mechanism shown in FIG. 2 is concerned, the device 1 may be of a conventional design that is not elaborated upon here in detail.

Like most known RVCs, for instance, the RVC's housing 100 may be wheeled and accommodate some standard features like an electromotor that is operably connected to the wheels of the housing; a programmable board computer configured to perform navigation—for instance with the aid of one or more onboard obstacle sensors and/or external beacons—and to accept and process user-inputted cleaning instructions; and a rechargeable battery that powers both the electromotor and the board computer. The housing 100 itself may have any suitable shape. In the depicted embodiment, for instance, the housing 100 is generally cylindrical, defining a top surface 102, a bottom surface 104, and a side surface 106 that interconnects the top and bottom surfaces.

The housing 100 may define a dust container reception compartment 108 configured to removably receive a dust container 200. To enable insertion and removal of the dust container 200 into/from the compartment 108, an outer surface of the housing 100 may define a dust container reception opening 110 that provides access thereto. In a preferred embodiment, the dust container reception opening 110 may be at least partly provided in the top surface 102 of the housing 100, i.e. a surface that, in use, faces upwards, away from the floor being vacuumed. Such placement of the opening 110 may enable a user to always comfortably access and operate the dust container 200, without him having to hold and/or pick up the RVC 1.

In addition to the dust container reception compartment 108, the RVC 1 may include a dust container 200 that is configured to be removably receivable therein via the dust container reception opening 110. The dust container 200 may typically comprise a dust container body 202 that defines an interior dust collection space 206, and a dust container lid 204 that is, optionally detachably, attached to the dust container body 202 and configured to openably seal the interior dust collection space 206. The dust container's 200 outer shape may be generally complementary to the inner shape of the dust container reception compartment 108, such that the dust container 200 can be fittingly received inside. As will become clear below, some overall play may be necessary in order to prevent the dust container 200 from accidentally getting jammed, and to enable the operation of a push-push mechanism 300 that provides for dust container reception and ejection functionality.

The dust container 200 may be received in the dust container reception compartment 108 in at least two alternative conditions.

Figure 2A:
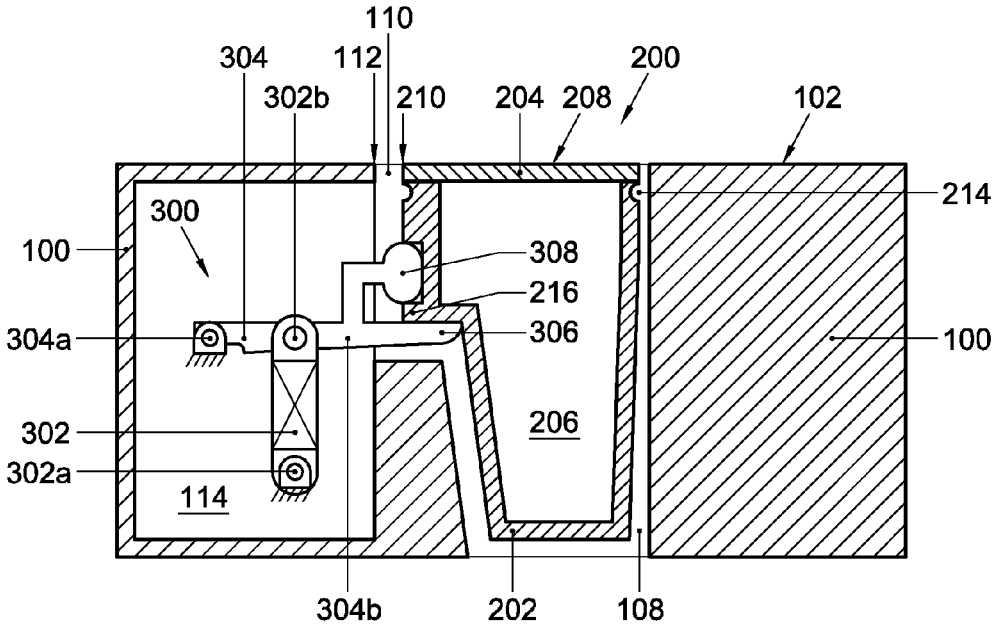
FIG. 2 is a schematic cross-sectional side view of the robotic vacuum cleaner shown in FIG. 1, illustrating a first exemplary embodiment of a dust container reception and ejection mechanism.

In a first condition, illustrated in FIG. 2A and referred to as the operationally received condition, the dust container 200 may be fully received inside the dust container reception compartment 108, such that an outer surface 208 of the dust container 200, which surface may be referred to as the 'push surface' for reasons to be explained infra, extends flush with the outer surface 102 of the housing 100. The push surface 208 may preferably be dimensioned to extend across substantially the entire dust container reception opening 110, i.e. across at least about ninety percent of the area thereof, when it occupies the operationally received condition, so as to effectively cover the opening and hide it from view. The top surface may merely show a narrow seam where the circumferential edges 112, 210 of the dust container reception opening 110 and the push surface 208 face one another.

Figure 2B:
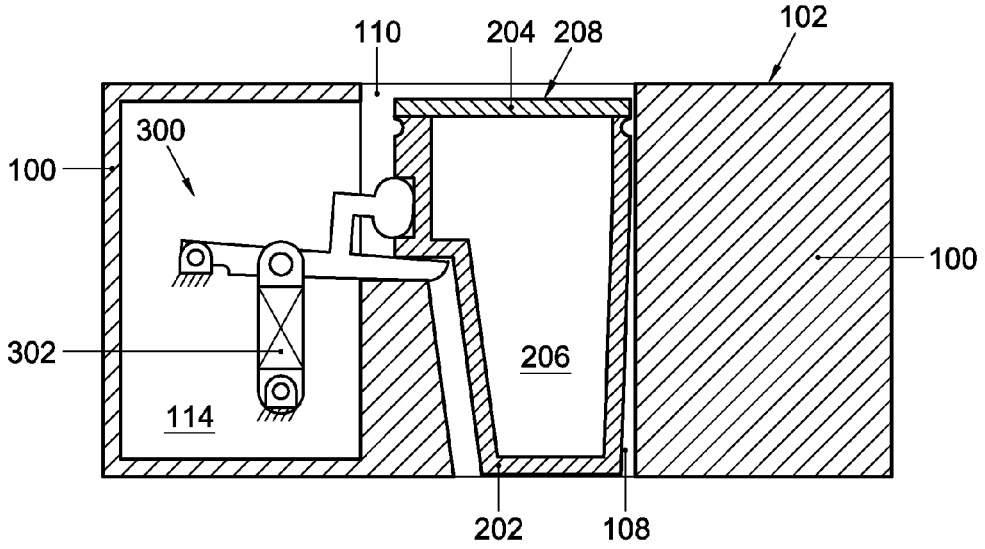
Figure 2C:
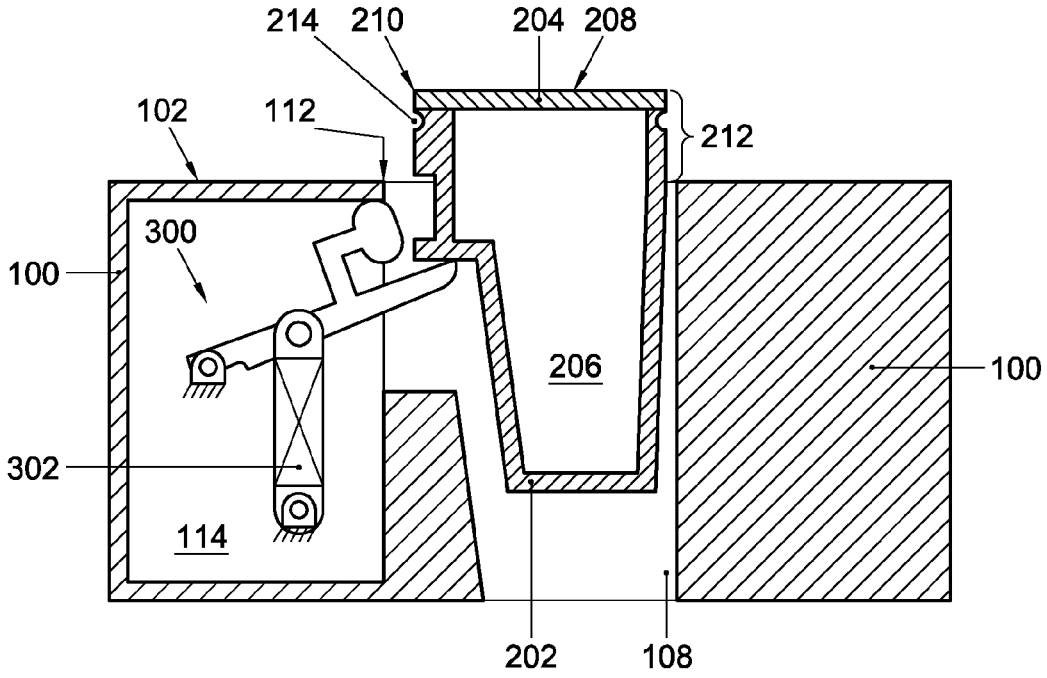

In a second condition, illustrated in FIG. 2C and referred to as the removably received condition, the dust container 200 may be only partially received inside the dust container reception compartment 108, such that its push surface 208 protrudes outwardly from the outer surface 102 of the housing 100. It is understood that the part of the dust container 200 that protrudes from the outer surface 102 of the housing 100 may serve as a hand-grippable feature. In a preferred embodiment, the push surface 208 may therefore protrude at least 5 mm, and more preferably at least 10 mm outwardly from the outer surface 102 of the housing 100 in the removably received condition. The distances of 5 mm and 10 mm, respectively, may be measured between, on the one hand, the circumferential edge 210 of the push surface 208 of the dust container 200 and, on the other hand, the circumferential edge 112 of the dust container reception opening 110, in a direction in which the dust container 200 is insertable and removable from the dust container reception compartment 108.

To further facilitate the gripping of the dust container 200 in its removably received condition, it may define a circumferential region 212 that, in the removably received condition, may extend between the circumferential edge 210 of the push surface 208 of the dust container 200 and the circumferential edge 112 of the dust container reception opening 110 in the outer surface 102 of the housing 100, and that defines a grip enhancing surface feature. In one embodiment, the grip enhancing surface feature may include a high-friction or roughened surface. In another embodiment, the grip enhancing surface feature may include at least one of a surface protrusion and a surface depression, e.g. a circumferential recess 214. An advantage of the latter features over the high-friction surface is that they may reduce the risk that the dust container 200 gets stuck inside the dust container reception compartment 108 due to friction between the circumferential region 212 and an inner wall of the dust container reception compartment 108.

The RVC 1 may also include a push-push mechanism 300, which may serve to maintain the dust container 200 in one of the operationally received condition and the removably received condition, and to enable a user to switch conditions by pressing and releasing the push surface 208 of the dust container 200. More specifically, the push-push mechanism 300 may be configured to maintain a received dust container 200 in the operationally received condition when the push surface 208 is pushed inwards into the housing 100 and released a first time, and to force the dust container 200 from said operationally received condition into the removably received condition when pushed inwards into the housing 100 and released a second time.

In the embodiment of FIGS. 1-2, the push-push mechanism 300 is largely disposed inside a cavity 114 within a wall of the dust container reception compartment 108; only the parts of the mechanism that interface directly with dust container 200 project from the cavity 114 into the compartment 108. The push-push mechanism 300 may include a push-push actuator 302, having a first end 302*a* that is fixedly connected to the housing 100 of the RVC, and a second end 302*b* that is movable relative to the first end 302*a* between at least a first position corresponding to the operationally received condition of the dust container (see FIG. 2A), and a second position corresponding to the removably received condition of the dust container (see FIG. 2C). The push-push mechanism 300 may further include a support arm or lever 304 that is configured to engage the dust container 200 so as to support it in both of the aforementioned conditions. The support arm 304 may extend between a first end 304*a* that is pivotally connected to the housing 100, and a second, free end 304*b* that is configured to detachably engage the dust container 200. In between its first and second ends 304*a*, 304*b*, the support arm 304 may be pivotally connected to the second, movable end 302*b* of the push-push actuator 302. At its second end 304*b*, the support arm 304 may be forked such that it defines at least two prongs 306, 308. In the depicted embodiment, one of the prongs 306 is elongate while the other 308 is generally elliptically shaped. The dust container 200 may complementarily define a support arm engagement portion 216 that, in an operationally received condition of the container 200, is engaged between said at least two prongs 306, 308 at the end 304*b* of the support arm 304. In the embodiment of FIG. 2, the support arm engagement portion 216 is defined by a ridge that separates a recess for reception of the elliptically shaped prong 308 of the support arm 304, and an (inverted) ledge for abutment with the elongate prong 306 thereof.

In the operationally received condition of FIG. 2A, the support arm engagement portion 216 of the dust container 200 is received between the prongs 306, 308 at the second end 304*b* of the support arm 304, such that the dust container 200 is essentially locked in place. The push-push actuator 302 may be configured to prevent (significant) angular/rotational movement of the support arm 304 about to its first pivotal end 304*a* under the influence of a force applied to the second end 304*b* that corresponds to a load less than the weight of a full dust container 200. Accordingly, the push-push actuator 302 may hold the dust container 200 in its operationally received condition, irrespective of the orientation of the RVC 1. That is, it may hold the dust container 200 in both a normal use orientation, as shown, and an upside-down orientation, which may occur when a user decides to manually pick up and move the RVC 1, for example to inspect its bottom side. At the same time, the prongs 306, 308 of the support arm 304 may engage the support arm engagement portion 216 sufficiently firmly to prevent it from rattling and shaking during use.

It is clear from FIG. 2A that the dust container 200 does not protrude from the housing of the RVC 1. A user is therefore unable to the grasp the dust container 200 to lift and extract it from the RVC's housing 100. To enable such removal, a user may press or push the push surface 208 of the dust container 200 inwards into the housing, as shown in FIG. 2B, and subsequently release it. As mentioned, the force required to this end may be slightly larger than the gravitational pull on a dust-filled dust container 200. The support arm 304 may communicate the downward press on the push surface 208 to the push-push actuator 302, so as to activate or trigger it and cause it to assume an extended configuration. Extension of the push-push actuator 302 may drive its first and second ends 302*a,b* apart, and thus force the support arm 304 in rotation about its first end 304*a*, thereby lifting the dust container 200 engaged at its second end 304*b*. The lift action may be performed primarily by a tip of the elongate prong 306, which maintains supporting contact with the support arm engagement portion 216 throughout the lift movement, while the elliptically shaped prong 308 may disengage the dust container engagement portion 216 during the lift and thus release the dust container for removal. Accordingly, at the end of the extension stroke of the push-push actuator 302, the dust container 200 may be in the removably received condition, shown in FIG. 2C.

To bring the dust container 200 back into its operationally received condition, the user may press the push surface 208 down into the housing 100 a second time, as shown in FIG. 2B, and subsequently release it again. The resulting compression of the push-push actuator 302 may activate it once more, and causes it to re-assume its shorter contracted state upon release. Accordingly, release of the push surface 208 may re-effect the condition shown in FIG. 2A.

Figure 3:
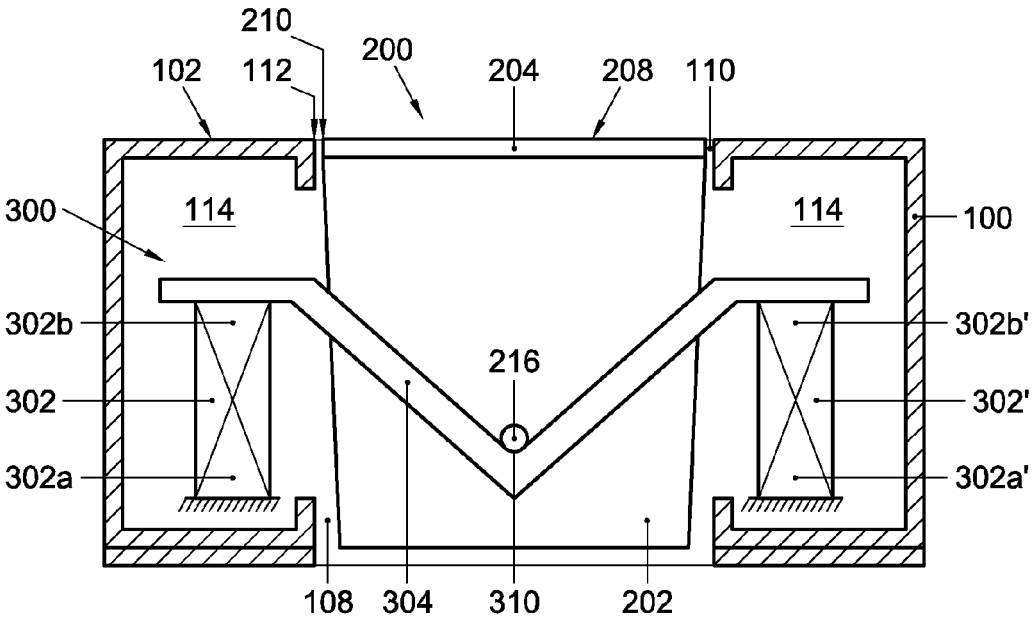
FIG. 3 is a schematic cross-sectional side view of a robotic vacuum cleaner similar to that shown in FIG. 1, illustrating a second exemplary embodiment of a dust container reception and ejection mechanism.
Figure 4:
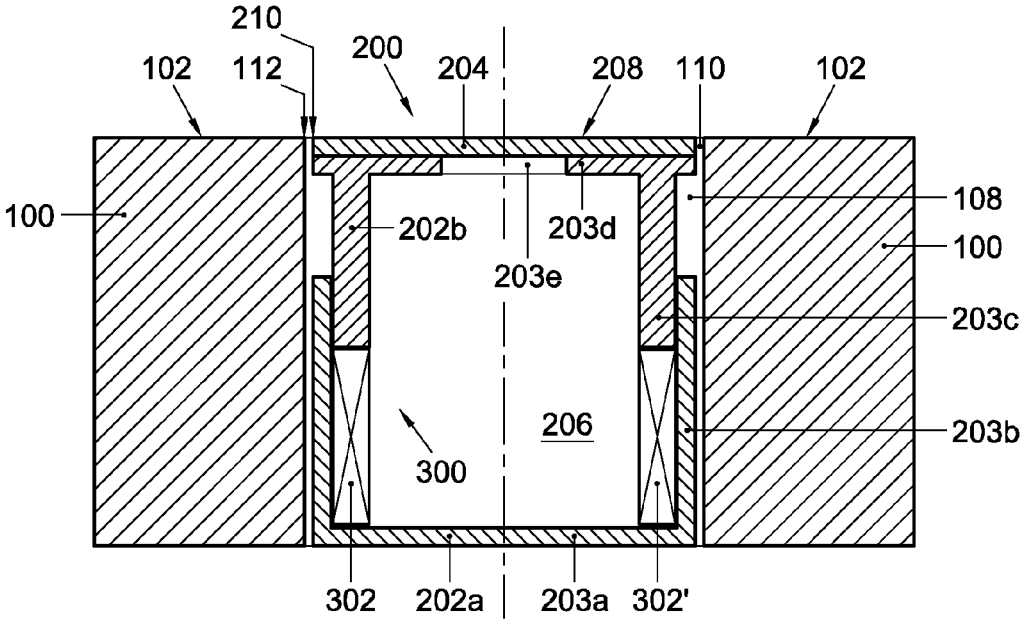
FIG. 4 is a schematic cross-sectional side view of the robotic vacuum cleaner similar to that shown in FIG. 1, illustrating a third exemplary embodiment of a dust container reception and ejection mechanism.

It will be clear that the implementation of a push-push mechanism-based dust container reception and ejection mechanism may differ for different embodiments of the RVC 1. By way of example, two alternatives to the implementation shown in FIG. 2 will be described below with reference to FIGS. 3-4. FIGS. 3-4 each illustrate an embodiment in which the dust container 200 is in its operationally received condition. Departing from this operationally received condition, the removably received condition may be effected by pressing down on the push surface 208 of the dust container 200, and subsequently releasing it, just as described above with reference to FIGS. 1-2.

In the embodiment of FIG. 3, the push-push mechanism 300 may include at least two spaced apart push-push actuators 302, 302', each similar to that discussed above with reference to the embodiment of FIGS. 1-2. The push-push mechanism 300 may further comprise at least one support arm 304 that rigidly interconnects pairs of second ends 302*b*, 302*b'* of the at least two push-push actuators 302, 302', so as to synchronize the movements of these second ends. Although FIG. 3 schematically illustrates the embodiment in a cross-sectional side view in which only two interconnected push-push actuators 302, 302' are visible, it is understood that the dust container 200 may in fact be supported by four push-push actuators. These four actuators may be spaced apart around the dust container reception compartment 108, and be interconnected by a single, annular frame that defines four support arms 304 which together enclose a central opening for reception of the dust container 200. Accordingly, the configuration of FIG. 3 may entail four-fold rotational symmetry with respect to a central, vertical axis of the dust container 200, and FIG. 3 may be regarded as one of four identical, mutually perpendicular cross-sectional side views. Each support arm 304 may, preferably at a point about halfway the respective interconnected second ends 302, 302*b*', define an upward facing support surface for supportingly receiving or engaging a dust container 200. The dust container 200 may complementarily be provided with one or more corresponding downward facing support surfaces. In the depicted embodiment, each support arm 304 defines an inverted (i.e. downward pointing) wedge-shaped section, a vertex region of which defines the upward facing support surface 310. A corresponding downward facing support surface is provided by a respective support arm engagement portion 216 in the form of a pin that projects from a side of the dust container body 202. The wedge-shaped support surface 310 may guidingly receive the pin 216 and seat the container 200 centrally within the dust container reception compartment 108. The overall symmetry of the configuration may prevent the dust container 200 from tilting during operation, and thus aid in keeping it clear from the walls of the dust container reception compartment 108. It is understood, however, that other embodiments may employ merely two interconnected push-push actuators 302, 302', typically disposed on opposite sides of the dust container 200, to avoid such undesirable tilting. In general, an embodiment featuring fewer interconnected push-push actuators may have a smaller risk of non-simultaneously triggering all push-push actuators and therefore a smaller risk of hampered operation.

FIG. 4 schematically illustrates a third exemplary embodiment of a dust container reception and ejection mechanism. It differs from the embodiments shown in FIGS. 1-3 in that the push-push mechanism 300 is completely integrated into the construction of the dust container 200. Specifically, the body of the dust container 200 may include a first portion 202*a* and a second portion 202*b*, which portions may together define an interior dust collection space 206. The first portion 202*a* may, for instance, define a bottom wall 203*a* and a first circumferential side wall 203*b* of the dust collection space 206, while the second portion 202*b* may define a top wall 203*d* and a second circumferential side wall 203*c* of the dust collection space 206. The top wall 203*d* may define an opening 203*e* that grants access to the dust collection space 206, and a dust container lid 208 may be provided on top of the top wall 203*d* to openably seal this opening. The first and second portions 202*a*, 202*b* of the dust container 200 may be movably interconnected. Their first and second side walls 203*b,c*, for instance, may slidably abut one another so as to enable a telescopic expansion of the dust collection space 206, or at least a variation in an outer dimension, e.g. a height, of the dust container 200. To control the variable outer dimension, the first and second portions 202*a*, 202*b* of the dust container body may be interconnected by a push-push mechanism 300 including at least one push-push actuator 302, 302'. The at least one push-push actuator 302, 302' may be configured to provide the dust container 200 with two alternative heights. As seen in a situation in which the first, lower portion 202*a* of the dust container 200 is fully sunk into the dust container reception compartment 108, one height may cause the dust container's push surface 208 to sit flush with the top surface 102 of the RVC's housing 100, while the other height may cause the push surface 208 to extend beyond the top surface 102 of the RVC's housing 100. The two alternative heights may thus correspond to the operationally received condition and the removably received condition of the dust container, respectively.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

LIST OF ELEMENTS

1 robotic vacuum cleaner (RVC)
100 housing
102 top surface of housing
104 bottom surface of housing
106 side surface of housing
108 dust container reception compartment
110 dust container reception opening
112 circumferential edge of dust container reception opening
114 cavity in side wall of dust container reception compartment
200 dust container
202 dust container body
202*a,b* first (a) and second (b) dust container body portion
203*a* bottom wall
203*b,c* first (b) and second (c) circumferential side wall
203*d* top wall
203*e* opening in top wall
204 dust container lid
206 internal dust collection space
208 push surface
210 circumferential edge of push surface
212 circumferential region
214 circumferential recess (in circumferential region)
216 support arm engagement portion
300 push-push mechanism
302 push-push actuator
302*a,b* first (a) and second (b) end of push-push actuator
304 support arm
304*a,b* first (a) and second (b) end of support arm
306 lower prong at second end of support arm
308 upper prong at second end of support arm
310 upward facing support surface

The invention claimed is:

1. A robotic vacuum cleaner, including:

a housing defining a dust container reception compartment that has a dust container reception opening in an outer surface of the housing;

a dust container configured to be removably receivable inside the dust container reception compartment via the dust container reception opening, such that, in an operationally received condition, an outer push surface of the dust container is flush with the outer surface of the housing, while in a removably received condition, the push surface of the dust container protrudes outwardly from said outer surface of the housing; and a push-push mechanism that is configured to maintain a received dust container in said operationally received condition when the push surface of the dust container is pushed inwards into the housing and released a first time, and to force the dust container from said operationally received condition into the removably received condition when pushed inwards into the housing and released a second time.

2. The robotic vacuum cleaner according to claim 1, wherein a top surface of the housing defines the outer surface of the housing in which the dust container reception opening is provided.

3. The robotic vacuum cleaner according to claim 1, wherein the push surface of the dust container, protrudes at least 5 mm outwardly from said outer surface of the housing in said removably received condition.

4. The robotic vacuum cleaner according to claim 1, wherein the dust container defines a circumferential region that, in said removably received condition, extends between a circumferential edge of the push surface of the dust container and a circumferential edge of the dust container reception opening in the outer surface of the housing, and wherein said circumferential region defines a grip enhancing surface feature including at least one of a surface protrusion and a surface depression.

5. The robotic vacuum cleaner according to claim 1, wherein, in the operationally received condition, the push surface of the dust container covers substantially the entire dust container reception opening.

6. The robotic vacuum cleaner according to claim 1, wherein the push-push mechanism includes:

a first push-push actuator, having a first end that is fixedly connected to the housing, and a second end that is movable relative to the first end between a first position and a second position; and a support arm that is connected to the second end of the first push-push actuator, such that the support arm is configured to maintain the dust container in the operationally received condition when the second end of the push-push actuator is in the first position, and the support arm is configured to maintain the dust container in the removably received condition when the second end of the first push-push actuator is in the second position.

7. The robotic vacuum cleaner according to claim 6, wherein the support arm extends between a first end that is pivotally connected to the housing, and a second end that is configured to engage the dust container, and wherein the second end of the first push-push actuator is pivotally connected to the support arm in between the first and second ends thereof.

8. The robotic vacuum cleaner according to claim 7, wherein the second end of the support arm is forked such that it defines at least two prongs, and wherein the dust container defines a support arm engagement portion that, in the operationally received condition of the container, is engaged between said at least two prongs.

9. The robotic vacuum cleaner according to claim 6, wherein the push-push mechanism further includes:

a second push-push actuator, spaced apart from the first push-push actuator and having a first end that is fixedly connected to the housing, and a second end that is movable relative to the first end between a first and a second position;

wherein the support arm is connected to the second ends of the first and the second push-push actuators so as to synchronize said actuator's actions, and wherein the support arm engages the received dust container at a point in between the second ends of the first and second push-push actuators.

10. The robotic vacuum cleaner according to claim 1, wherein the dust container includes a first portion and a second portion, said portions being movably interconnected through the push-push mechanism, such that an outer dimension of the dust container is variable by pushing the push surface of the received dust container inwards into the housing and subsequently releasing it.

* * * * *